US006634322B2

(12) United States Patent
Cohen

(10) Patent No.: US 6,634,322 B2
(45) Date of Patent: Oct. 21, 2003

(54) HEAT EXCHANGER TEMPERING VALVE

(75) Inventor: Joseph D. Cohen, Aurora, CO (US)

(73) Assignee: Cold Fire, LLC, Aurora, CO (US)

( * ) Notice: Subject to any disclaimer, the term of this patent is extended or adjusted under 35 U.S.C. 154(b) by 0 days.

(21) Appl. No.: 09/834,585

(22) Filed: Apr. 12, 2001

(65) Prior Publication Data

US 2002/0148416 A1 Oct. 17, 2002

(51) Int. Cl.[7] ..... F01P 7/14
(52) U.S. Cl. ..... 123/41.1; 236/99 E; 236/101 C
(58) Field of Search ..... 123/41.1; 236/34.5, 236/99 E, 99 K, 101 A, 101 B, 101 C

(56) References Cited

U.S. PATENT DOCUMENTS

| | | | | | |
|---|---|---|---|---|---|
| 1,791,756 | A | * | 2/1931 | Fay | 236/34.5 |
| 3,120,926 | A | * | 2/1964 | Gobien et al. | 236/34.5 |
| 3,313,483 | A | * | 4/1967 | Nallinger | 236/34.5 |
| 3,805,748 | A | * | 4/1974 | Garcea et al. | 123/41.1 |
| 4,522,334 | A | | 6/1985 | Saur | |
| 4,539,944 | A | | 9/1985 | Garcea et al. | |
| 4,550,693 | A | | 11/1985 | Saur | |
| 4,691,668 | A | | 9/1987 | West | |
| 4,774,977 | A | | 10/1988 | Cohen | |
| 4,895,301 | A | | 1/1990 | Kennedy | |
| 5,117,898 | A | | 6/1992 | Light et al. | |
| 5,123,591 | A | | 6/1992 | Reynolds | |
| 5,419,488 | A | | 5/1995 | Saur et al. | |
| 5,497,734 | A | | 3/1996 | Okada | |
| 5,503,118 | A | | 4/1996 | Hollis | |
| 5,529,025 | A | | 6/1996 | Ranzinger et al. | |
| 5,617,816 | A | | 4/1997 | Saur et al. | |
| 5,758,607 | A | | 6/1998 | Brendel et al. | |
| 5,836,269 | A | | 11/1998 | Schneider | |
| 5,868,105 | A | * | 2/1999 | Evans | 123/41.5 |
| 5,934,552 | A | | 8/1999 | Kalbacher et al. | |
| 5,934,553 | A | | 8/1999 | Fournier | |
| 5,979,778 | A | | 11/1999 | Saur | |
| 6,039,263 | A | | 3/2000 | Kalbacher et al. | |

OTHER PUBLICATIONS

"Mixed–flow impeller pumps up efficiency", by John Lewis, Northeast Technical Editor—Feb. 26, 2001; http:/www.manufacturing.net/dn/index/asp?layout=articlePrint&articleID=CA108447, Sep. 27, 2001, pp. 1–2.

* cited by examiner

*Primary Examiner*—Noah P. Kamen
(74) *Attorney, Agent, or Firm*—Hogan & Hartson L.L.P.

(57) ABSTRACT

An automatic heat exchanger tempering valve designed to maintain a consistent temperature of a fluid within a machine. The tempering valve is configured to sense fluid temperature and in response, to proportion the flow of the fluid from the machine between a heat exchanger and an either internal or external by-pass flow circuit. The valve includes a movable valve diverter positionable in multiple positions to create a variety of proportionate flows of the total fluid flow stream between the heat exchanger and the by-pass flow circuit. The valve diverter is positioned by a multiple position valve actuator that changes the position of the diverter by reacting to a change in fluid temperature. The valve and the bypass flow circuit are easily installed within a motor vehicle by simply splicing into the two radiator hoses in the engine compartment.

2 Claims, 12 Drawing Sheets

HEAT EXCHANGER TEMPERING VALVE

BACKGROUND OF THE INVENTION

1. Field of the Invention

The invention relates in general to machines, such as internal combustion engines, power transmissions, and turbines, which use fluids for cooling, heating, lubrication, or power transmission, and more specifically to a heat exchanger tempering valve for use in a motor vehicle coolant system to provide a more consistent coolant temperature to enhance motor efficiency and component longevity.

2. Relevant Background

Machines, like internal combustion engines, power transmissions, and turbines, typically use fluids for cooling, heating, lubrication, or power transmission. These machines usually have an optimum operating temperature at which they operate the most efficiently as far as creating the most power, experiencing the least wear to the parts, and expelling the least unspent fuel in the exhaust. This optimum operating temperature is often determined by controlling the temperatures of the operating fluids.

In an attempt to achieve these optimum operating temperatures, fluids are used to collect or absorb heat from portions of the machines they contact and are then circulated through a radiator or heat exchanger to dissipate the collected, excess heat from the machine. The rate the fluids absorb or transfer heat away from the contacting portions of the machine typically varies widely depending on a number of factors such as the temperature differential between the contacting portions and the cooling fluid and the chemical makeup of the cooling fluid (which may vary over time). The cooling cycle is continuously repeated with the now lower temperature cooling fluid. Unfortunately, the rate a heat exchanger or radiator dissipates heat is generally fixed, e.g., is not adjustable, and the heat exchanger does not compensate changes in the rate a machine develops heat or in heat transfer rates, which results in undesirable fluid operating temperatures and fluid operating temperatures that vary during machine operation leading to fluctuating operating efficiencies and compromised part life.

Automobile engine cooling systems provide excellent examples of the inherent problems of trying to bring a machine to a desired operating temperature and then to maintain an optimum fluid operating temperature for that particular machine, e.g., keeping a cooling fluid or coolant in or near a desired operating temperature range. Liquid cooled engines generally have passages for coolant through the cylinder block and head and has indirect contact with other engine parts such as pistons, cylinders, valve seats and guides. As the coolant flows through the passages, the coolant absorbs heat from the engine parts and then is passed through the radiator to dissipate the absorbed heat (or a portion of the absorbed heat).

During typical operations, once an engine reaches a set operating temperature, a thermostat valve opens fully to circulate all of the engine's coolant through the radiator. However, this all or nothing approach does not always provide effective control over the coolant temperatures. Often, too much heat is dissipated by the radiator, which results in an engine's actual operating temperature being below the engine's optimum operating temperature. Also, the vehicle accessories that rely on hot coolant, such as the heater and defroster, may not operate satisfactorily.

In addition to low operating temperature problems, the engine may produce more heat than the radiator can timely dissipate and the engine overheats to temperatures above the optimum operating temperature or temperature range. If overheating continues, portions of the vital coolant will be lost through a pressure relief system in the radiator cap and the vehicle may be disabled, e.g., components may be damaged and/or the engine may shutdown.

A number of variable factors affect the rate an automobile engine develops heat and the rate an automobile radiator dissipates heat. These factors include load, engine speed, vehicle speed, gear ratio, ground surface condition, rate of climb or decent, acceleration or deceleration, air temperature, wind speed, vehicle direction in relation to wind speed, precipitation, vehicle accessory equipment operation, age and condition of the vehicle, age and condition of the engine fluids. Existing liquid coolant systems are not effective in addressing these numerous heat generation and dissipation variables, and are particularly ineffective in handling fluctuations and rapid changes in these variables.

Hence, there remains a need for a method or system for improving the operation of fluid temperature control systems for machines, such as automobile engines, that provides enhanced control of the operating temperature of the machine by better maintaining the temperature of the fluids within a desired operating temperature range. Preferably such a method and system would be adapted for real time and ongoing control over the coolant temperature because there are a number of variables which constantly factor into the operating temperature of a machine. Further, it is preferable that such a method and system be configured to automatically adjust the rate that heat is dissipated from the machine without operator intervention.

SUMMARY OF THE INVENTION

Accordingly it is an object of the present invention to provide an add-on hydraulic system for motor vehicles which, once installed on the vehicle, automatically maintains a consistent optimum operating temperature of the engine coolant, and therefore, the engine, respective of operating conditions.

It is an object of the present invention to provide an add-on hydraulic system for motor vehicles which is universal, and therefore can be added to most vehicles, provided an appropriately-sized system is used.

It is an object of the present invention to provide an easy-to-install system in which the installer can simply splice the system valve and tee into the two radiator hoses and then connect them together with a third hose.

It is further an object of the present invention to provide a fluid temperature maintenance system for machinery which is totally kinetic, without any electrical components, and because of its simplistic design, offers an exceptional level of reliability, durability, and serviceability.

It is additionally an object of the present invention to provide a system that can be easily added to both the coolant and oil systems of a race car, since they typically have independent fluid cooling systems for both fluids.

It is also an object of this invention to provide a fluid temperature maintenance system that is in constant thermal communication with the machine, and rapidly adjusts the rate of heat dissipation as per the immediate needs of the machine.

It is an object of the present invention to provide a fluid temperature control system for a motor vehicle that automatically adjusts to seasonal changes and eliminates any need for mechanical adjustment to the vehicle cooling system to compensate for summer and winter conditions.

Further, it is the object of this invention to provide improved power, improved fuel efficiency, lower exhaust emissions, extended engine oil life, and improved operation of the heater and defroster for a motor vehicle by maintaining the optimum operating temperature of the engine.

Even though the present invention is specifically designed to work with motor vehicles, it also has application with any machine and heat exchanger system that requires temperature maintenance of an integrated fluid.

To achieve the foregoing and other objects and in accordance with the purposes of the present invention, a preferred embodiment of the present invention is a three-port automatic tempering valve that provides a selective bypass of fluid flow through a heat exchanger. When utilized to provide temperature control in an engine cooling system, the valve is installed into an influent line that provides flow to a heat exchanger (e.g., the radiator) from the engine. The automatic tempering valve of the present invention includes a by-pass outlet connection that is piped to a tee installed into the effluent heat exchanger line, which provides flow from the heat exchanger to the engine. In this manner, the automatic tempering valve and connecting piping and components provide a by-pass flow circuit in parallel to the heat exchanger. During operation of the engine, the valve operates automatically to select volumes of flow and direct flow to either the by-pass flow circuit or the heat exchanger. According to an important aspect of the invention, the fluid flow can be selected to be all to the heat exchanger, all to the by-pass flow circuit, and, significantly, concurrently to both the by-pass flow circuit and the heat exchanger. More particularly, depending on the heat dissipation needs of the engine, the automatic tempering valve proportionately divides coolant flow between the by-pass flow circuit and the heat exchanger.

To achieve the proportional flow control feature of the invention, one preferred embodiment of the automatic tempering valve includes a set of thermostatic actuators, such as thermostatic wax motor actuators and the like. The thermostatic actuators are preferably set to actuate sequentially at different temperatures (e.g., a set of predetermined, increasing in magnitude temperatures) and are positioned within a continuous circulation fluid flowstream. The actuators are positioned to act upon a singular proportioning flow diverter within a multiport valve body. During operation, the set of actuators function in combination to provide the total movement of the flow diverter with each thermostatic actuator providing a segment or portion of the total diverter movement with each set at an independent temperature.

In a preferred embodiment, the diverter is spring-loaded toward the cold position (e.g., directing all flow to the by-pass flow circuit to quickly raise the operating temperature of the engine) and the actuators sequentially operate as operating temperature increases to move the diverter toward the hot position (e.g., directing all flow to the radiator). In between the cold position and the hot position, flow is divided between the by-pass flow circuit and the radiator, with more flow being directed to the by-pass flow circuit when the fluid temperature is below the desired or optimum operating temperature or at the lower end of a desired temperature range and more flow being directed to the radiator when the fluid temperature is above the desired operating temperature or at the upper end of the desired temperature range. On an ongoing and real-time basis, the tempering valve reacts to fluctuations in coolant fluid temperature by adjusting the appropriate portion of flow directed into the heat exchanger by the automatic operation of the thermostatic actuators.

DETAILED DESCRIPTION OF THE PREFERRED EMBODIMENTS

The present invention provides a method and system for effectively controlling fluid flow on an ongoing and real-time basis based on the temperature of the fluid used to cool or heat a machine. A flow control system is provided that operates to sense the present temperature of the fluid and, in response, operates to control the volume of fluid flow directed to a heat exchanger and to a by-pass circuit (which is configured to direct fluid around the heat exchanger and back to the machine). The flow control system is uniquely adapted to selectively proportion flow to either or both the heat exchanger and the by-pass circuit to dissipate a proper amount of absorbed heat from the fluid to maintain the temperature of the fluid (and, the machine) at a temperature that is within a predefined optimum operating range (such as plus or minus a temperature margin of a set operating temperature). This proportional, real-time flow control allows the flow control system to responsively and rapidly adjust fluid flow (and heat dissipation) based on the numerous operating variables that effect heat generation and removal within an operating machine.

The following disclosure is provided in the setting of a coolant system of a typical internal combustion engine for ease of illustration and understanding. However, those skilled in the art will readily understand that the flow control system (and, specifically, the automatic tempering valve of the system) can be utilized in nearly any machine in which fluids are utilized to remove excess heat or for which it is desirable to maintain operating fluids within a desired operating range. Further, specific materials and components, system configurations, and operating parameters (such as optimum operating temperatures and ranges) are provided for illustration only of the inventive features of the flow control system and not as limitations. The important features of the invention, such as proportional flow control in response to sensed coolant temperature, may be achieved with other materials, components, system configurations, and operating parameters than those specifically listed and these modifications to the following examples are considered within the breadth of the following disclosure and claims.

Figure 1:
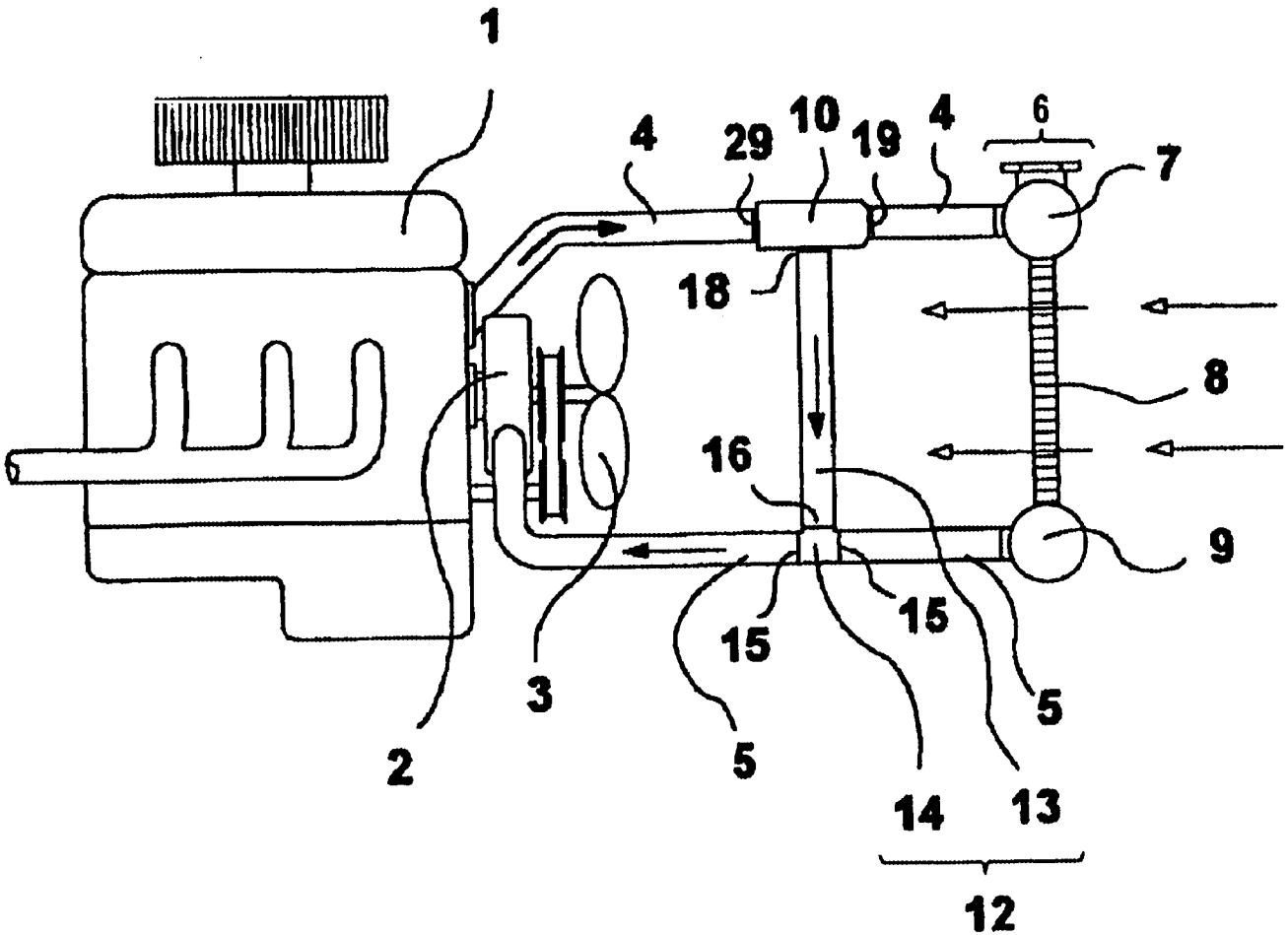
FIG. 1 is a diagrammatical plan view of the flow circuits for a cooling system of a motor vehicle utilizing an automatic tempering valve with a 3-port configuration and an external by-pass flow circuit (e.g., a flow control system) according to the present invention. In this illustration, the automatic tempering valve is operating in the "cold position" to direct the total flow in the cooling system to the external bypass flow circuit.
Figure 2:
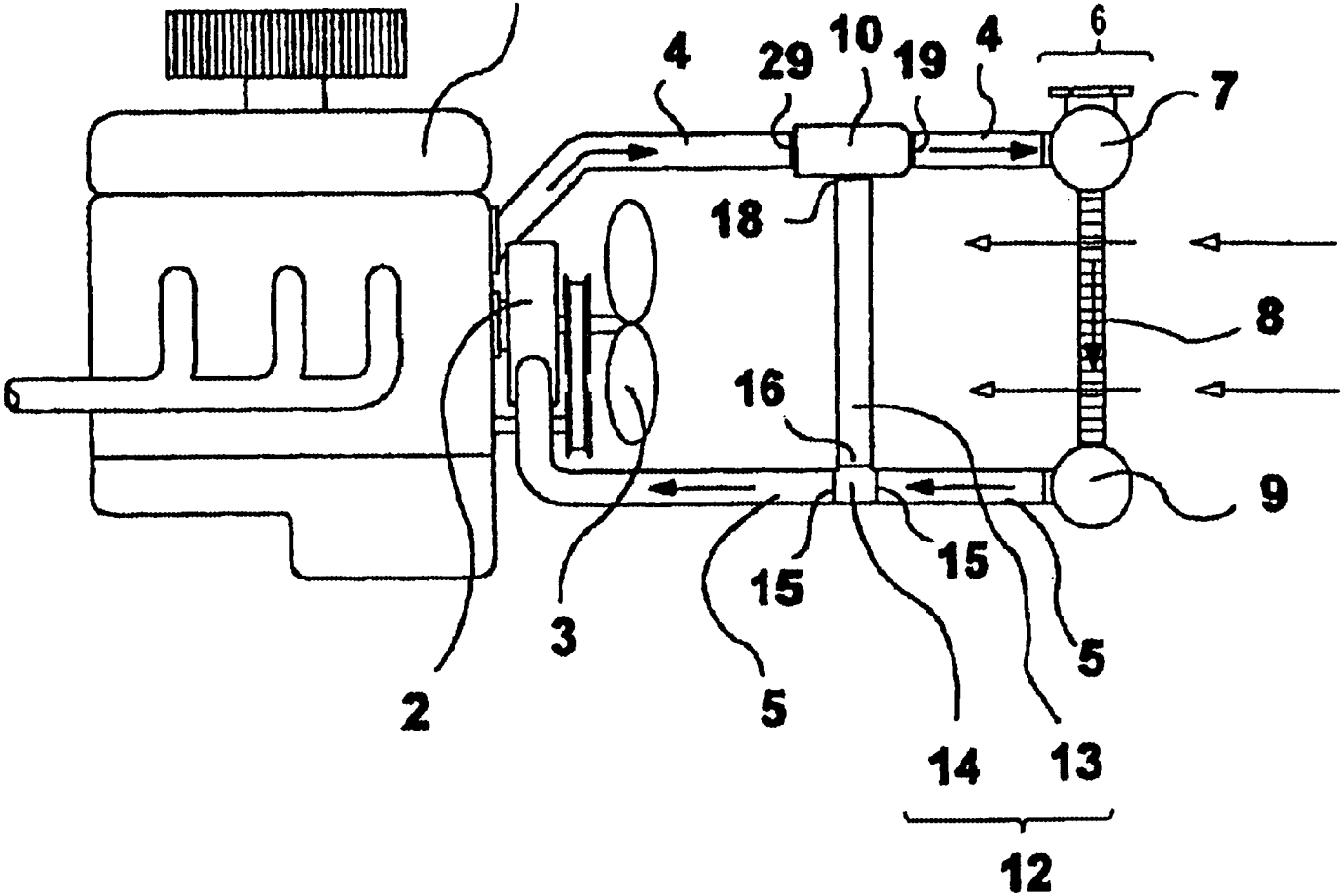
FIG. 2 is a diagrammatical plan view similar to that of FIG. 1 with the automatic tempering valve operating in the "hot position" to direct the total flow to the radiator.
Figure 3:
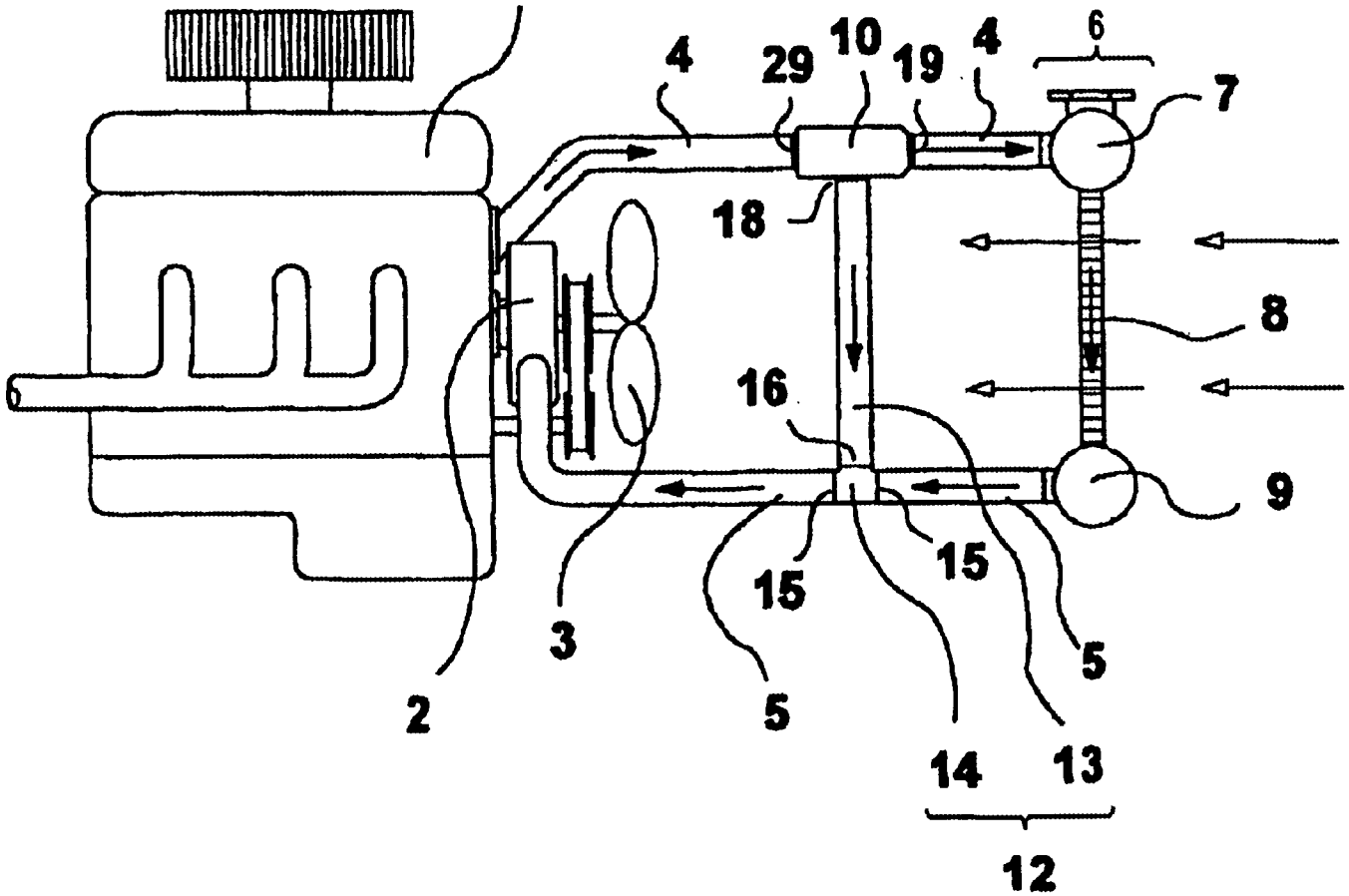
FIG. 3 is a diagrammatical plan view similar to that of FIG. 1 with the automatic tempering valve operating between the cold and hot positions of FIGS. 1 and 2 to effectively and continually proportionally direct the flow between the radiator and the by-pass circuit, e.g., with a fraction or percentage of the coolant flow being concurrently directed to the by-pass circuit and the remainder of the flow to the radiator.
Figure 4:
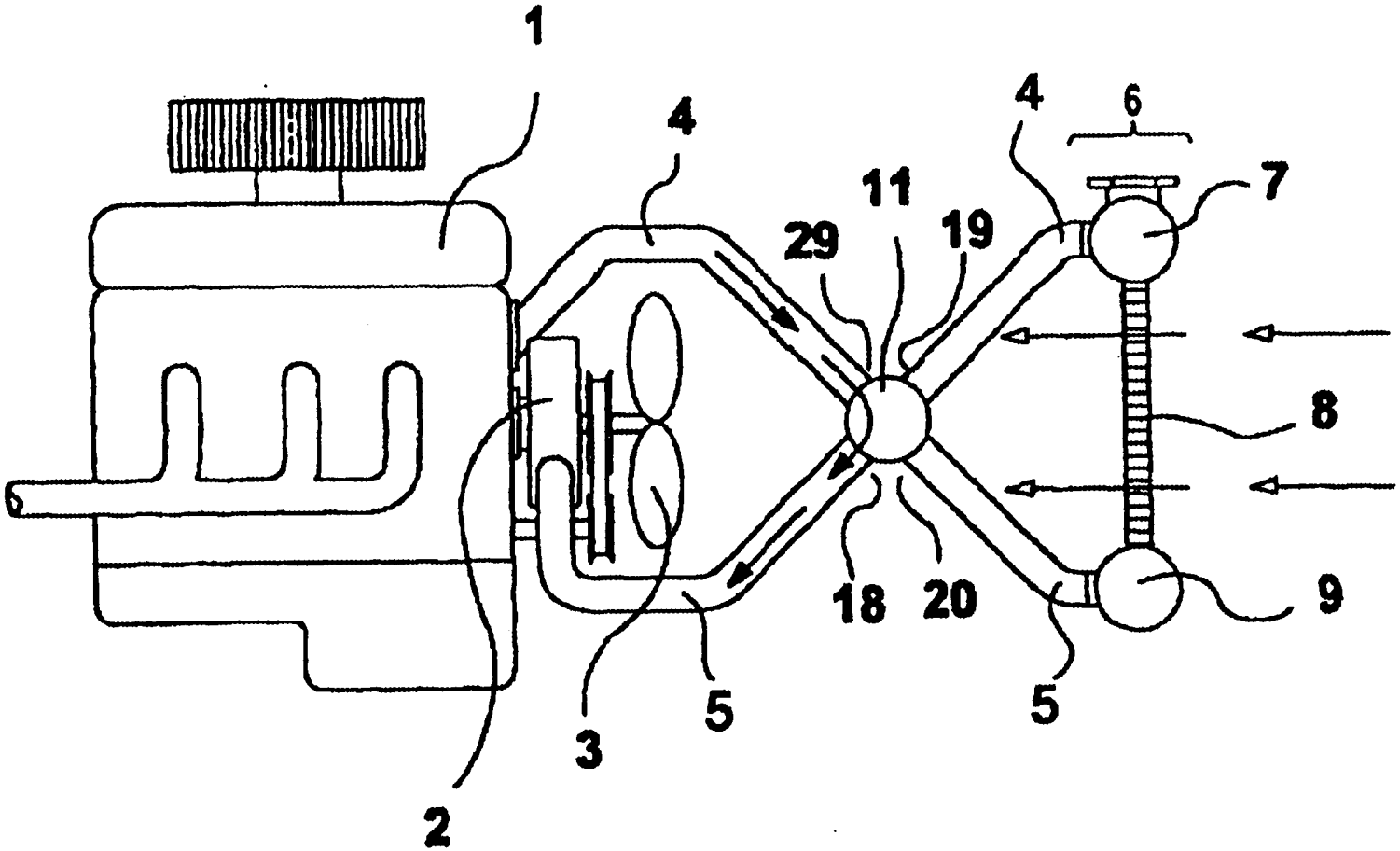
FIG. 4 is a diagrammatical plan view of the flow circuits for the cooling system of a motor vehicle utilizing another embodiment of a flow control system of the present invention with an automatic tempering valve with a 4-port configuration and an internal by-pass flow circuit integrated within the valve. In this illustration, the automatic tempering valve is operating in the "cold position" to direct the total flow to the by-pass flow circuit.
Figure 5:
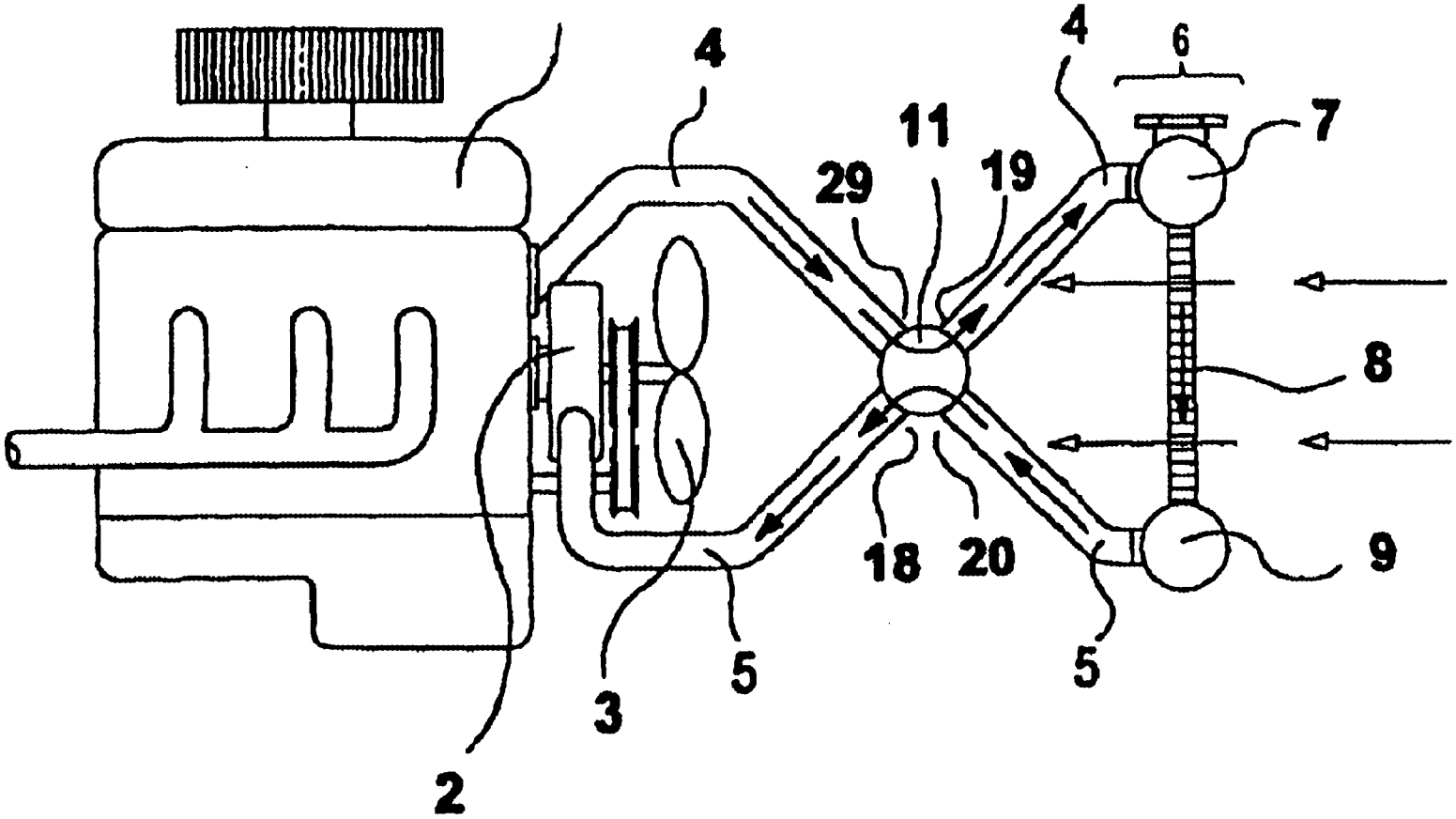
FIG. 5 is a diagrammatical plan view similar to that of FIG. 4 with the automatic tempering valve operating in a "hot position" to direct the total flow to the radiator.
Figure 6:
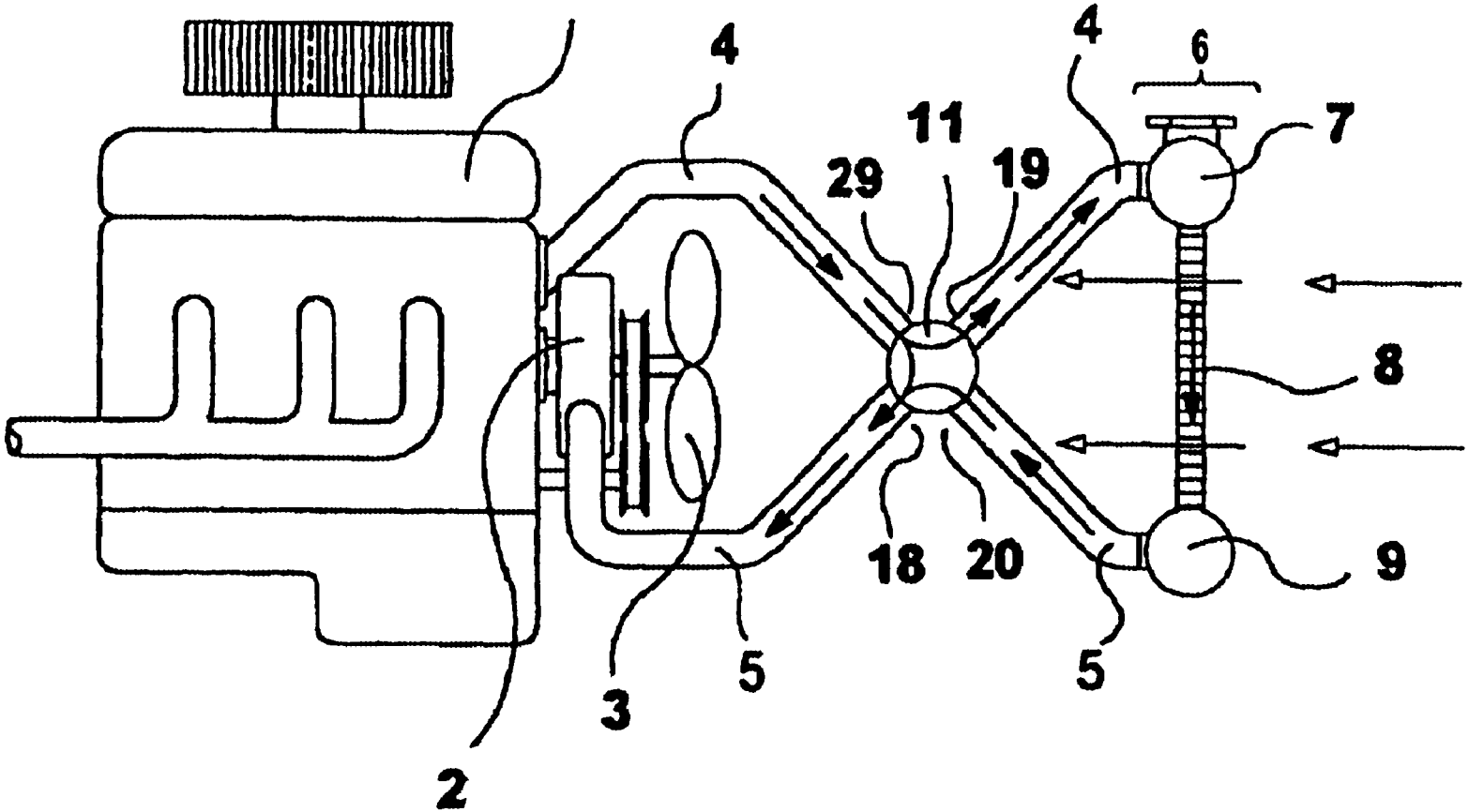
FIG. 6 is a diagrammatical plan view similar to that of FIG. 4 with the automatic tempering valve operating between the cold and hot positions to proportionally direct the flow concurrently and automatically between the radiator and the by-pass circuit depending on the temperature of the coolant.

FIGS. 1–6 are diagrammatical plan views of the cooling system flow circuits created within a motor vehicle with two embodiments of the flow control system of the present invention. Generally, the flow control system includes a tempering valve 10, 11 and the piping and components useful in creating a radiator by-pass flow circuit 12. The first embodiment shown in FIGS. 1–3 utilizes a three-port configuration for the automatic tempering valve 10, and the second embodiment shown in FIGS. 4–6 utilizes a four-port configuration for the automatic tempering valve 11. Three fundamental flow scenarios are shown for each of the embodiments including full coolant flow to the by-pass flow circuit 12 (FIGS. 1 & 4) (e.g., the cold position), full coolant flow to the radiator 6 (FIGS. 2 & 5) (e.g., the hot position), and coolant flow proportioned between the by-pass flow circuit 12 and the radiator 6 (FIGS. 3 & 6). FIGS. 1–3 illustrate these three flow scenarios utilizing a three-port tempering valve 10 to proportionally and automatically (based on coolant temperature sensed within the valve 10) control coolant flow. FIGS. 3–6 illustrate these same three flow scenarios utilizing a four-port tempering valve 11 to control coolant flow and thereby, control the coolant temperature within a selectable and typically, predefined temperature range.

Referring to FIGS. 1–3, the reader will note that the motor vehicle engine 1 is connected to the radiator 6 with two hoses including the radiator influent hose 4 and the radiator effluent hose 5. A circular flow circuit for liquid coolant is therefore provided between the engine 1 and the radiator 6. The radiator includes a radiator influent collector tank 7, fin tubes (core) 8, and a radiator effluent collector tank 9. A water pump 2 provides coolant flow, and air (shown by open arrows) is drawn by the fan 3 through fin tubes 8 of the radiator 6 to dissipate heat from the coolant in the radiator 6.

Referring now to FIG. 1, the flow control system of the invention is installed to provide a second circular flow circuit away from and back to the engine 1. To achieve this bypass of the radiator 6, the flow control system includes the tempering valve 10 and the by-pass flow circuit 12, which as illustrated includes by-pass hose 13 connected to the by-pass port 18 of the 3-port tempering valve 10.

In FIG. 1 illustrates the cold position of the tempering valve 10. As shown, the total flow of coolant flowing from the engine 1 into the radiator influent hose 4 is directed into the by-pass flow circuit 12 by the 3-port automatic tempering valve 10, and directly back to the engine 1 by entering the radiator effluent hose 5 through the by-pass hose 13 and the tee 14 installed in the radiator effluent hose 5. In this embodiment, the by-pass flow circuit 12 is composed of the by-pass hose 13 and the tee 14 but of course different piping and connection configurations may be employed to direct the coolant from the valve 10 back to the engine 1. During operation of the engine 1 and the flow control system, the automatic tempering valve 10 directs the coolant flow as shown in FIG. 1 when the coolant is cool, such as under 180° F. for many engine designs. At these lower temperatures (e.g., below desired operating temperature ranges) there is no need to dissipate heat and it is preferable to operate the tempering valve 10 to direct coolant flow to more quickly raise the operating temperature of the engine 1 to the optimum operating temperature range.

According to one aspect of the invention, the tempering valve 10 is configured to continually sense the temperature of the coolant flowing out of the engine 1 in radiator influent hose 4 and to operate in response to this sensed coolant temperature to direct flow to the radiator 6, to the by-pass flow circuit 12, or proportionally to each. In this regard, as illustrated in FIG. 1, even though there is no or only minimal flow through the radiator 6, the coolant is continuing to flow (as indicated by arrows) through the by-pass flow circuit 12 via the by-pass port 18 in valve 10, thus keeping the tempering valve 10 in constant thermal communication with the engine 1, e.g., the coolant being discharged from cooling passages in the engine 1. This ongoing coolant temperature monitoring feature allows the tempering valve 10 to immediately or quickly adjust to the present, e.g., the real-time, need of the engine 1 to dissipate or retain heat to maintain the engine in a desired operating temperature range.

FIG. 1 also illustrates why the present invention is so easily added to most any motor vehicle. First note that the tempering valve 10 is spliced directly into the influent radiator hose 4 at the engine port 29 and the radiator port 19, which are located on the opposite ends, and, are axially aligned on the cylindrical tempering valve 10. Further, the tee 14 is spliced into the radiator effluent hose 5 at the two run connections 15 of the effluent hose, which are also axially aligned. Finally, the by-pass hose 13 is simply connected between the by-pass port 18 on the tempering valve 10, and the outlet connection 16 on the tee 14. The illustrated configuration of the flow control system is particularly well-suited for use with most current coolant system designs for engines 1, but the features of the invention can readily be adapted for other coolant system designs with non-cylindrical valves 10 and other by-pass hose 13 and tee 14 configurations.

In FIG. 2, the tempering valve 10 is shown in the hot position of operation directing the total or substantially the total coolant flow to the radiator 6 (as shown by the single arrow in the fin tubes 8) and no flow is being directed to the by-pass flow circuit 12. This illustrates how the tempering valve 10 can be set for a desired operating temperature range, sense when the coolant temperature is outside (above) the temperature range or at the high end of the temperature range, and automatically direct (such as by operating to fully open) all of the coolant flow to the radiator 6. Such operation is desirable when the engine 1 is operating above the maximum desired temperature for the engine 1 as indicated by the temperature of the coolant in the radiator influent hose 4. In other words, this is the flow path automatically created by the tempering valve 10 of the flow control system when the need to dissipate heat from the engine 1 is at or near a maximum, thereby significantly increasing the efficiency of heat dissipation or heat transfer by the radiator 6.

According to an important aspect of the invention, the flow control system includes the tempering valve 10, which is configured uniquely to operate between the cold position and the hot position to proportionally divide flow concurrently to both the by-pass circuit 12 and the radiator 6. By operating a majority of the time in this range of "proportioning positions", the tempering valve 10 functions effectively to maintain the temperature of the coolant flow in influent hose 4 at or near a desired optimum operating temperature or within a relatively narrow operating temperature range. In FIG. 3, the tempering valve 10 is shown by two flow arrows operating to divide the flow of coolant from the engine 1 between the radiator 6 and the by-pass flow circuit 12. This represents the coolant flow pattern created by the tempering valve 10 during periods of operation of the engine 1 when the engine 1 is operating at an intermediate temperature, e.g., when coolant in influent hose 4 is substantially equal to a predefined optimum operating temperature or within an optimum operating temperature range.

Turning to FIG. 4, another embodiment of a flow control system according to the present invention is shown that utilizes a 4-port automatic tempering valve 11 to provide the functions of the 3-port tempering valve 10 and the bypass hose 13 and tee 14. As shown in FIG. 4, the tempering valve 11 is in the cold position that creates the coolant flow pattern useful when the engine 1 is cold or is operating at a temperature below the optimum temperature or outside the predefined optimum operating temperature range. The engine coolant system is configured or modified to include the tempering valve 11 having, not three, but four ports. These four ports are the engine port 29, the by-pass port 18, the radiator hot port 19, and the radiator cold port 20. In this manner, the by-pass flow circuit 12 of the flow control system of FIGS. 1–3 is functionally replaced with or occurs within the four-port tempering valve 11.

FIG. 5 illustrates the same flow control system as shown in FIG. 4 utilizing the four-port tempering valve 11 but showing another operating position of the tempering valve 11. As shown, the engine 1 is operating at maximum temperature or at least outside the predefined optimum operating temperature range set for the valve 11 or above the set temperature of the valve 11. At this operating condition, the need to dissipate heat is high or even at a maximum, and the tempering valve 11 preferably operates automatically to direct the full flow of the coolant entering the valve 11 from the engine 1 to the radiator 6 to release excess heat.

FIG. 6 illustrates the flow control system as shown in FIGS. 4 and 5 utilizing the four-port tempering valve 11 but showing the important proportioning or dividing operating of the tempering valve 11. As shown, the engine 1 is operating at an intermediate temperature as sensed by the tempering valve from the coolant in influent hose 4 entering via port 29. In other words, the need to dissipate heat from the engine 1 via the radiator 6 is moderate (e.g., between the cold and hot positions of the valve 1). Consequently, the tempering valve 11 is configured to automatically operate to direct only a portion of the total coolant flow to the radiator 6, and the remainder of the coolant flow to the by-pass flow circuit created within the valve 11 to the by-pass port 18 and the radiator effluent hose 5. For example, if sensed coolant temperature is at the predefined optimum operating temperature or at about a midpoint of the predefined optimum operating temperature range, the valve 11 may be configured to operate automatically to divert half of the flow to the radiator 6 via radiator hot port 19 and half of the flow to the engine 1 via by-pass port 18 (or some other proportion that has been determined to work to maintain the current sensed coolant temperature). Similarly, at temperatures above the optimum operating temperature, a larger portion of the coolant flow would be sent to the radiator 6. With a general understanding of the flow control system of the invention, it may now be helpful to fully discuss the components and operation of the tempering valve 10 that provide the unique features of coolant temperature sensing and real time, automated operation to control coolant flow to the radiator 6.

Figure 7:
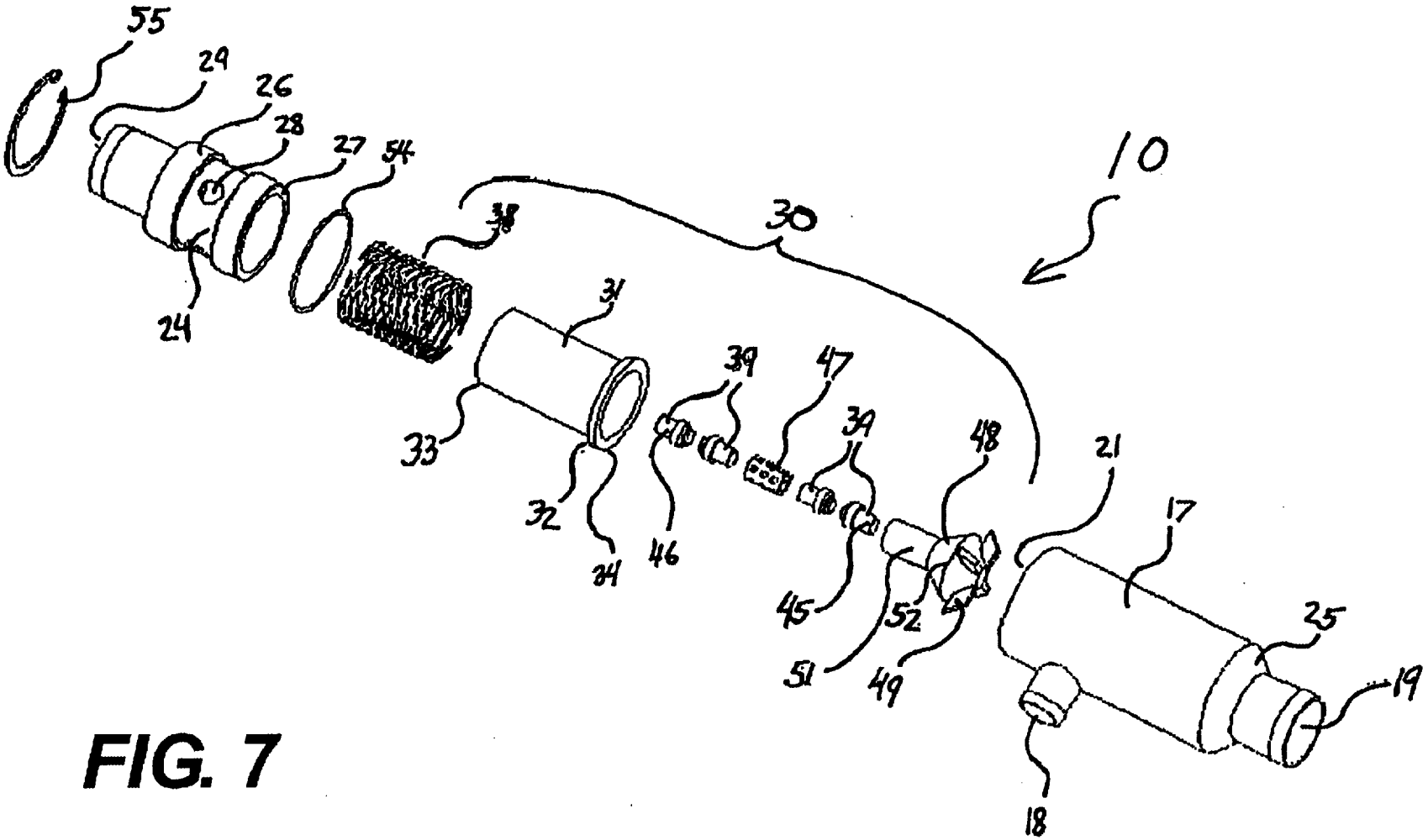
FIG. 7 is an exploded view of the tempering valve of FIG. 1 with the 3-port configuration illustrating individual parts.

FIG. 7 is an exploded view of a preferred embodiment of the tempering valve 10 of the present invention having a three-port multiport valve configuration. Simplicity of design is apparent in this illustration as the tempering valve 10 includes a small number of components. The potential for external leakage is greatly minimized because the working mechanism 30 is totally contained within a valve body 17 of the valve 10 eliminating the need for problematic external seals on dynamic parts.

The internal working mechanism 30 of the tempering valve 10 is powered or automatically operated by a number of thermostatic actuators 39 positioned in abutting contact along the same axis, such as the central axis of the valve 10. Preferably, the thermostatic actuators 39 are selected to accurately sense a temperature by actuating or operating when nearby coolant in the valve 10 exceeds a specific temperature or temperature range. The number of actuators 39 included is determined by the accuracy of the control desired and the number of positions desired for the valve 10 (e.g., the number of proportional divisions of flow desired, such as 2, 3, 4, 5, and so on).

Figure 8:
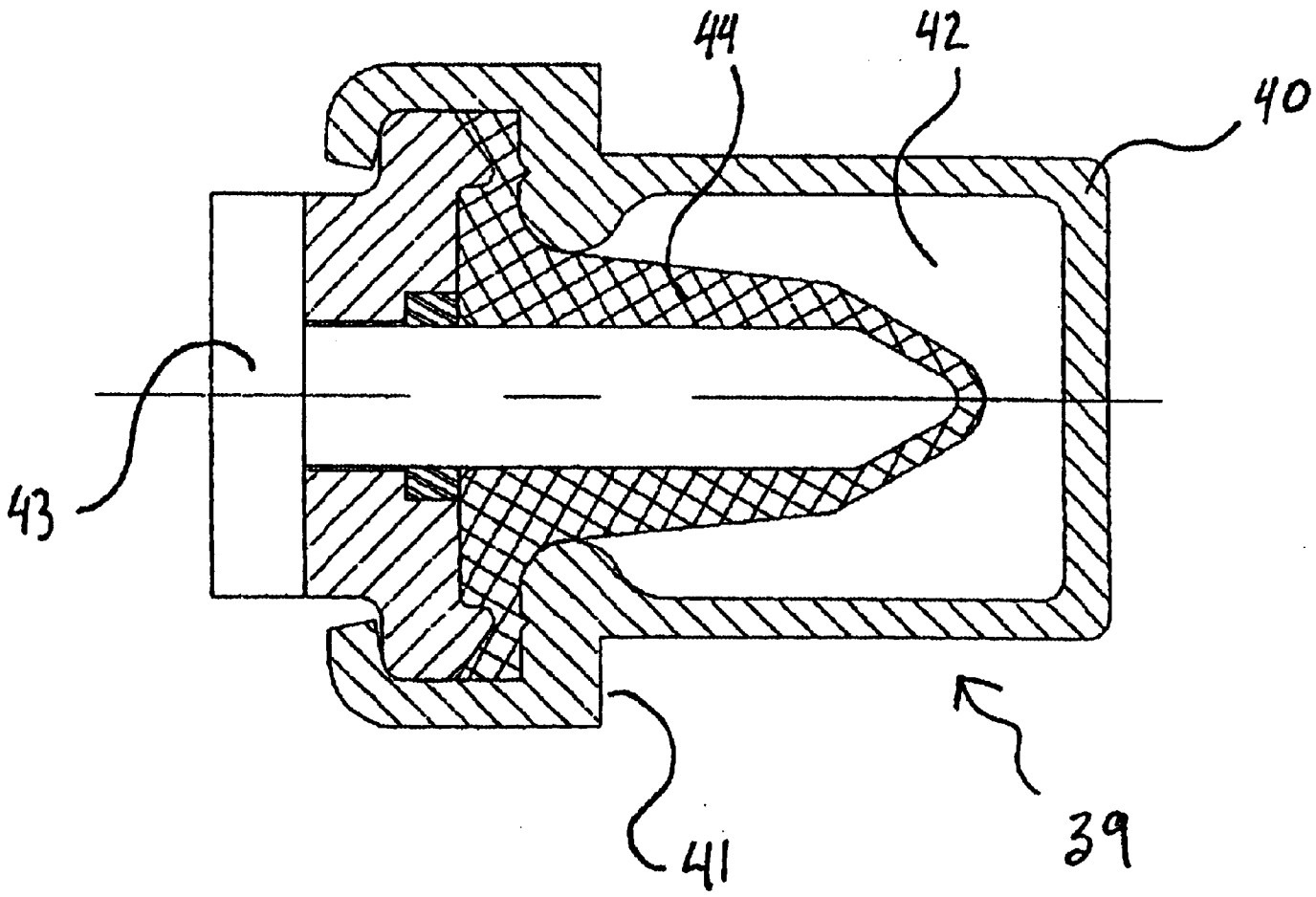
FIG. 8 is a cross-sectional side view of an exemplary thermostatic wax motor actuator of the tempering valve illustrated in FIG. 7.

For example, in one preferred embodiment, four actuators 39 are used to achieve three proportional positions between the cold and hot positions as the coolant temperature is sensed to be increasing (e.g., 25/75 radiator/by-pass, 50/50 radiator/bypass, and 75/25 radiator/by-pass). Although a number of thermostatic actuators may be employed, the tempering valve 10 has been found to be particularly effective and accurate in sensing temperature and controlling flow when the thermostatic actuators 39 are thermostatic wax motor actuators. As shown in FIGS. 7 and 8, the wax motor actuators 39 are sealed units, such as permanently sealed units that are pre-calibrated to actuate at a specific and selectable temperature.

To better understand the operation of the actuators 39, FIG. 8 illustrates a cross-sectional side view of one of the thermostatic wax motor actuators 39. The actuator housing 40 is filled with a specially designed wax or fill 42. A housing shoulder 41 is included which mates with a thrust connection 35 of the valve 10 to position the actuator 39 along the center axis of the valve 10. As the temperature of coolant contacting the housing 40 and therefore the temperature of the wax 42 is increased, the wax 42 eventually reaches a temperature or melt point at which the solid wax liquefies (e.g., the wax phase changes). This actuation temperature can be selected because the temperature or melt point depends on a number of factors such as the composition and volume of the wax 42, the material selected for the housing 40, and the like. As the temperature of the wax 42 increases, the wax 42 increases in volume, thus pushing on the elastomeric sleeve 44 which contacts and moves the actuator piston 43 axially outward and away from the actuator housing 40. Conversely, as the coolant and wax 42 temperatures decrease, the wax 42 reaches the point at which the liquid wax re-solidifies, and spring pressure on the actuator piston 43 (by the elastomeric sleeve 44 or other components) causes the actuator piston 43 to retract back into or toward the actuator housing 40.

Figure 9:
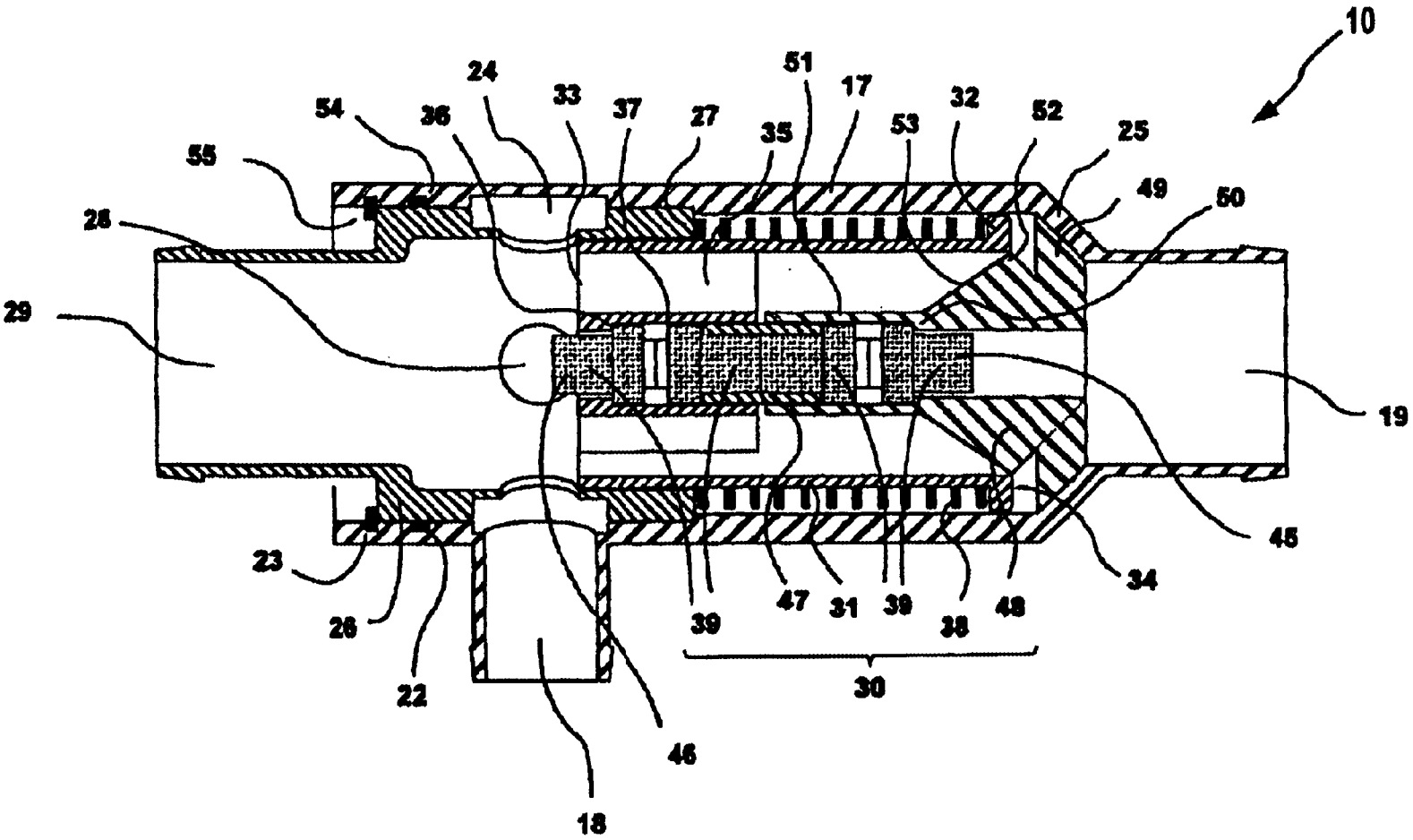
FIG. 9 is a cross-sectional assembled side view of the tempering valve of FIG. 7 having the 3-port configuration.
Figure 10:
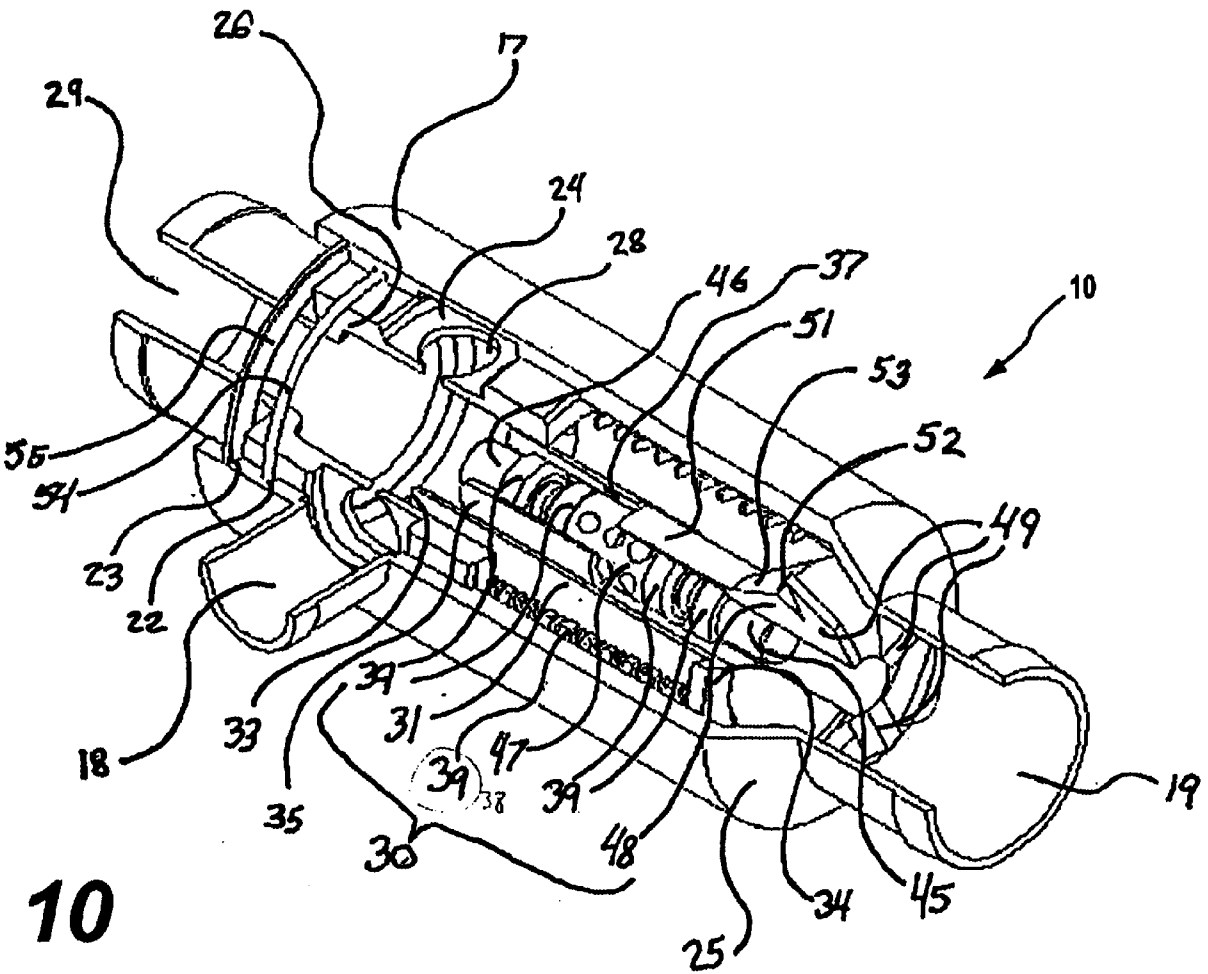
FIG. 10 is an isometric cutaway assembled view of the tempering valve of FIGS. 7 and 9 having the 3-port configuration.

In the preferred embodiment of the present invention illustrated in FIGS. 7, 9 and 10, four thermostatic wax motor actuators 39 are incorporated in the valve to provide a plurality of proportional coolant flow settings to better respond to changing coolant temperatures. Each actuator 39 is configured to actuate (or expand in axial length) at a different temperature such as by filling each actuator 39 with a different composition of wax 42. In one preferred embodiment of the valve 10, the four thermostatic wax motor actuators 39 sequentially actuate on 5° F. intervals to react to temperature increases in the coolant and properly control coolant flow to maintain desired operating temperatures of the engine 1. Of course, larger intervals may be used such as to provide flow control over larger optimal operating temperature ranges or with fewer actuators 39 and smaller intervals may be used for smaller optimal operating temperature ranges or tighter control with more than four actuators 39. For example, in an internal combustion engine with four actuators 39, the preferred set points may be 185° F., 190° F., 195° F., and 200° F. With these temperature set points and with the axially aligned, end-to-end arrangement illustrated, the four thermostatic wax motor actuators 39 provide a total movement on a valve diverter 31 comprised of five increments (e.g., closed or cold position, approximately 75/25, approximately 50/50, approximately 25/75, and open or hot position), dependent upon the number, 0–4, of thermostatic wax motor actuators 39 which contain liquefied wax 41.

Referring now to FIG. 9 (with further reference to FIG. 7), an assembled cross-sectional view of the preferred embodiment of the present invention in the "cold configuration" is shown. As illustrated, all four of the thermostatic wax motor actuators 39 are in the retracted "cold" position, which directs all flow entering the engine port 29 to be directed out the by-pass apertures 28 to the by-pass port 18 and circuit 12. Two of the four actuators 39 fit into the thrust connection tube 37 which is rigidly attached to the diverter 31. The remaining two actuators 39 fit into the throttle tube 51 of the throttle 48. The throttle 48 is rigidly positioned within the valve body 17 by the throttle support ribs 49 being in contact with the valve body reduction section 25. Also, the actuators 39 are held in position along the center axis of the cylindrical valve body 17 by the tube 37 within the thrust connection 35 (which is attached to the diverter 31), the actuator coupling 47, and the throttle tube 51. Note, the downstream actuator 45 within the throttle 48 is held fixed to the throttle 46 by the throttle shoulder 50, and the upstream actuator 46 is held fixed to the diverter 31 by the thrust connection shoulder 36. When the actuators 39 sequentially activate, they apply a force against the diverter that moves it axially into the end plug 26 to close or block the by-pass apertures 28 and direct at least a portion of coolant flow to the radiator hot port 19 and the radiator 6.

Note, the diverter 31 is biased toward the throttle 48 by the compression spring 38 (or other resilient spring or member useful for predictably resisting axial compression), which is contained within the valve body 17. The compression spring 38 exerts force between the inner edge 27 of the end plug 26 and the diverter shoulder 32. To provide axial movement to provide flow control, the diverter 31 is slideably mounted within the inside of the end plug 26. As a result of this arrangement, as the thermostatic wax motor actuators 39 extend in length due to an increase in temperature (after coolant temperatures exceed each actuator's melt or phase change point), they work in combination to increase the distance between the diverter 31 and the throttle 48. This movement of the diverter 31 provides proportional flow control between the by-pass port 18 and the radiator hot port 19.

As illustrated in FIG. 9, the working mechanism 30 is in the "cold" position. The engine port 29 is located in the end plug 26 and the radiator hot port 19 is on the valve body 17. In this embodiment, these two ports, 29 and 19, are axially aligned (although other non-aligned arrangements may be useful in some coolant system configurations). Coolant will flow from the engine port 29 to the radiator hot port 19 only if the coolant can flow through the inside of the diverter 31. In the cold position, however, flow is blocked by the alignment of the diverter trailing edge 34 with the throttle ridge 52. As the diverter 31 is moved away from the throttle 48 by the increase in length of the four thermostatic wax motor actuators 39 (preferably, one at a time). As a result, the diverter trailing edge 34 is aligned with the throttle tapered section 53 and progressively opens the linear flow path between the engine port 29 and the radiator hot port 19. Hence, proportional flow control is achieved automatically in response to coolant temperature changes as flow increases to the radiator hot port 19 as fluid temperature increases and flow decreases to the by-pass port 18 as apertures 28 are blocked by the repositioned diverter 31.

More specifically, as shown in FIG. 9, the diverter leading edge 33 is not covering the by-pass apertures 28. Coolant flow into the valve body 17 from the engine port 29 can flow freely through the by-pass apertures 28, into the by-pass collector gland 24, and then on into the by-pass port 18. As the diverter 31 advances toward the engine port 29 as the fluid temperature increases and the length of the actuators 39 increase, the diverter leading edge 33 progressively blocks the openings of the by-pass apertures 28, and at the most advanced position (e.g., the hot position) completely blocks the flow to the by-pass port 18 by completely covering the by-pass apertures 28.

As can be seen from the above discussion, the use of multiple thermostatic actuators in abutting contact with a diverter 31 that contacts a throttle 48, at least in part, provides the unique proportioning flow control of the tempering valve 10. The proportional flow control is provided automatically and responsively (e.g., the actuators actuate rapidly as their phase change points are reached). As the diverter 31 is advanced along its linear stroke by the increase in length of the actuators 39, the valve 10 progressively opens a flow circuit between the engine port 29 and the radiator hot port 19 as it inversely progressively closes the flow circuit between the engine port 29 and the by-pass port 18. The tempering valve 10 thereby proportionately sends a large fraction or proportion of the coolant entering the engine port 29 to the radiator hot port 19 as the coolant temperature increases.

FIG. 10 is an isometric cutaway assembled view of the tempering valve 10 that illustrates how the simplicity of this design also facilitates assembly. First, the working mechanism 30 is assembled. The upstream actuator 46 is placed into the thrust connection 35 located within the diverter 31, and the downstream actuator 45 is placed in the throttle tube 51. The remaining two actuators 39 placed into the actuator coupling 47, which is shown perforated to allow coolant to contact the interior actuators 39. The aforementioned three subassemblies are stacked as illustrated, and dropped into the valve body 17 so that the throttle support ribs 49 come in contact with the sloped reduction section 25 of the valve body 17.

Next, the compression spring 38 is dropped into the valve body 17 so that it fits around the diverter 31 and contacts the diverter shoulder 32. Numerous spring or resilient members may be used to provide the functions of the spring 38 with spring constants and materials selected to suit the coolant compositions and temperatures and to provide desirable resistance to the actuators 39 (e.g., strong enough to hold the actuators 39 in place but not so resistive to compression that the actuators 39 are allowed to actuate). The O-ring seal 54 is positioned in the O-ring gland 22 on the inside of the valve body 17. The O-ring seal 54 should be coated with a compatible lubricant, like silicone grease, to ease final assembly. Finally, the end plug 26 is pressed into the access port 21 of the valve body 17 until the inner edge 27 contacts and at least partially compresses the compression spring 38 to force the spring 38 against the diverter shoulder 32 of diverter 31. The end plug 26 is then secured in place with the retainer snap ring 55 that is positioned into the retainer ring gland 23 in the valve body 17. The O-ring seal 54 provides a seal against external leakage from occurring between the valve body 17 and the end plug 26.

Note, that thermal shocking can sometimes occur if flow streams are quickly changed from full cold flow to full hot flow and vice versa. With this in mind, the automatic throttling mechanisms are designed without elastomeric seals to achieve non-positive off positions. Referring to FIG. 9, the automatic throttling mechanism for the radiator flow path is provided by the spatial relationship of the diverter trailing edge 34 and the throttle ridge 52. There is some diametral clearance between these two ports so that there is a small amount of flow to the radiator 6 when the valve 10 is in the "cold" position. Similarly, the automatic throttling mechanism for the by-pass flow circuit 12 (FIG. 1) is provided by the spatial relationship of the diverter leading edge 33 and the by-pass apertures 28 located in the end plug 26. Again, there is no elastomeric seal between the parts, but rather, some diametral clearance is provided so that when the by-pass is completely closed in the "hot" position there is still some flow to the by-pass port 18.

With this full, detailed description of 3-port valve 10, those skilled in the art will readily understand without the need for full illustrations how one or more thermostatic actuator 39 can be utilized to operate a 4-port tempering valve 11 (shown in FIGS. 4–6). However, for a full description with illustrations of the working of one 4-port valve useful for tempering valve 11, see U.S. Pat. No. 4,774,977 to Joseph D. Cohen, which is incorporated herein by reference. The valve 11 is again configured with actuators 39 (such as four thermostatic wax motor actuators) set with differing set point to proportion flow between an internal by-pass flow circuit and the radiator 6. In the cold position, the actuators 39 are set to not actuate (such as below 180° F.) and all or most coolant flow is directed to the internal by-pass flow circuit back to the engine 1. In the hot position (such as above 200° F.), all of the actuators 39 are set to actuate, closing the by-pass flow control circuit, and fully opening flow to the radiator hot port 19 (of FIG. 3) and to the radiator 6. In between these two temperature points or settings, the tempering valve 11 functions automatically via the included actuators 39 to proportion flow between the hot port 19 and the by-pass port 18.

As discussed for valve 10, the proportioning may be achieved by including four actuators 39 with four different set points (e.g., wax melt points differing by 5° F. for a 20° F. optimum operating temperature range or smaller differentials for a smaller temperature range). This again results in five flow control positions for the valve 11 including the cold/closed position, the hot/open position, one quarter op en, one half open, and three quarters open. Numerous port arrangements may be utilized and in one embodiment, the body of the valve 11 includes an engine port 29 for receiving hot coolant from the engine 1, a radiator hot port 19 for discharging the received coolant to the radiator 6, a radiator cold port 20 for receiving lower temperature coolant from the radiator 6, and a by-pass port 18 for discharging by-passed coolant and coolant received from the radiator 6 back to the engine 1. To achieve a by-pass circuit within the valve body of the valve 11, the engine port 29 and the radiator cold port 19 are aligned on a first axis and the radiator hot port 19 and the by-pass port 18 are aligned on a second axis, the first and second axis being perpendicular to facilitate control of flow by the actuators 39 that position the diverter 31 to selectively create fluid communication between the various ports 18, 19, 20, and 29.

The diverter (see, for example, FIG. 11) utilized in the four-port valve 11 may differ from the one illustrated for valve 10. For example, a diverter may be provided that includes a planar member twisted 90° along its axis such that the diverter is generally helix in shape. With this planar member, the diverter is preferably positioned within the valve body to be substantially axially aligned with a center axis of a cylindrical interior portion of the valve body of the valve 11. To achieve effective flow control, the diverter is moveable along the center axis of the cylindrical valve body, which creates fluid communication between a first two pairs of adjacent valve body ports at one end of a diverter stroke (such as port 29 communicating with port 18 and port 19 communicating with port 20) and creating fluid communication between a second two pairs of adjacent valve body ports at a second, opposite end of the diverter stroke (such as port 29 communicating with port 19 and port 20 communicating with port 18). In a preferred embodiment, the movable helix diverter is indexed within the interior portion of the valve body so as to be fixed in relation to the interior portion of the valve body.

The tempering valve 11 may include other diverter embodiments (not shown), such as using a butterfly disc rotatable about a central axis of the disc. In this embodiment, the disc of the diverter preferably is positioned within the valve body such that the disc axis is transverse to a plane containing the center axii of the valve body ports. In this embodiment, instead of the cylindrical valve body shown for valve 10, the valve body of the four-port valve 11 may include a generally spherical interior portion for better housing the diverter disc.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the thermostatic actuators 39 may be arranged so as to actuate in any order (not necessarily from upstream to downstream or vice versa). A smaller or larger number of actuators 39 may be employed to achieve a desired proportioning flow control. Additionally, numerous flow throttling configurations may be used to practice the invention with the configuration of the throttle 48, diverter 31, and other valve 10, 11 components being a preferred but not limiting arrangement for effectively practicing the disclosed flow control system and method.

Figure 11:
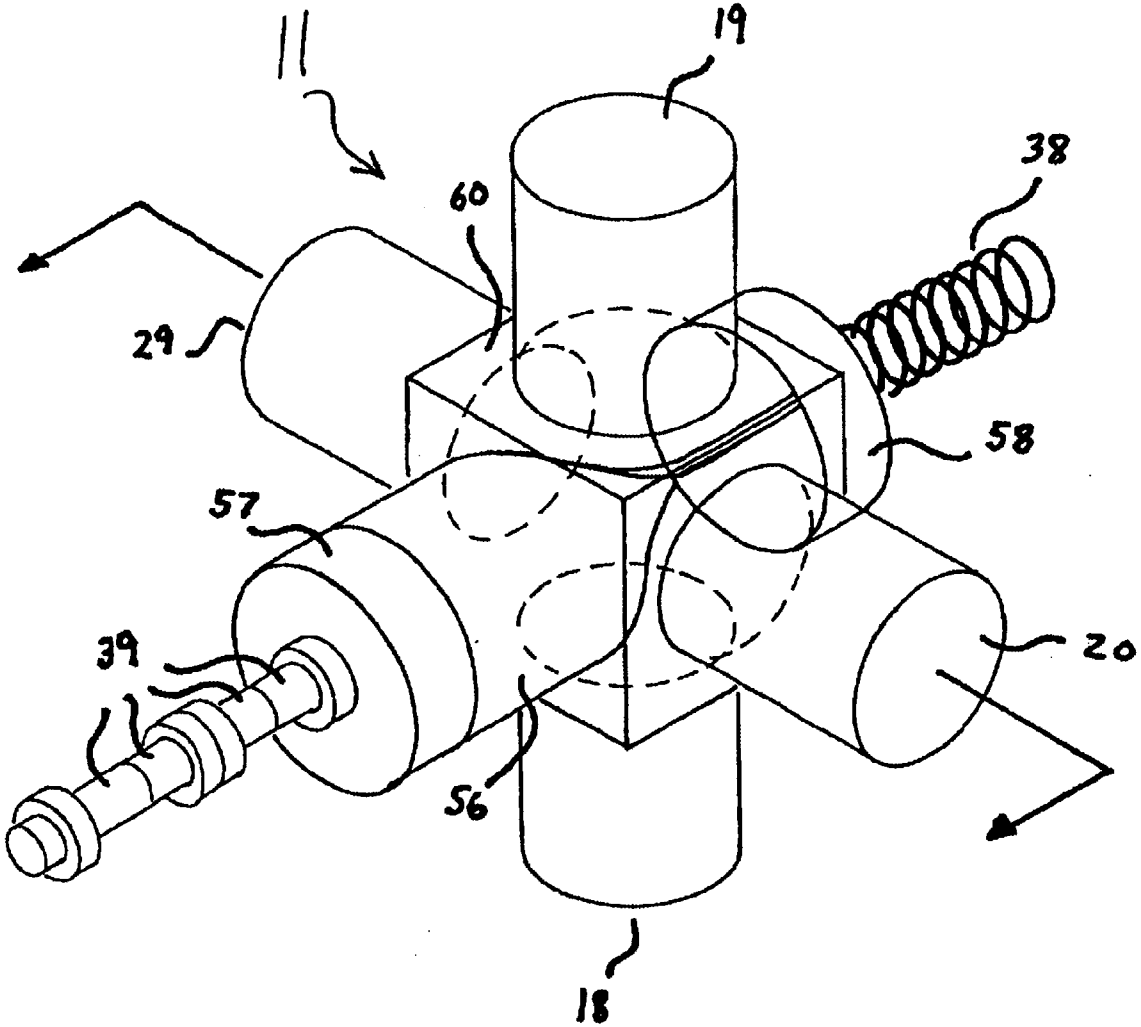
FIG. 11 is an isometric, ghosted view of a tempering valve showing an exemplary 4-port configuration.

Referring to FIG. 11, an isometric ghosted view of the present invention in the 4-port configuration utilizing a helix diverter 56. In this embodiment, the engine port 29 is adjacent to the radiator hot port 19 and the by-pass port 18, and the engine port 29 is opposite the radiator cold port 20. Also note, that opposite ports are axially aligned and the axis of all four ports 29, 19,18, 20 lie in the same plane and intersect at common point (such as the center of the tempering valve 11. Now note the helix diverter 56 is slideably mounted within the valve body 60 on an axis perpendicular to the plane defined by the axis of the four ports 29, 19,18, 20. Further, the helix diverter 56 includes an actuator thrust piston 57 which is in mechanical contact with the thermostatic wax motor actuators 39, and a spring thrust piston 58 which is in mechanical contact with the compression spring 38.

Figure 12:
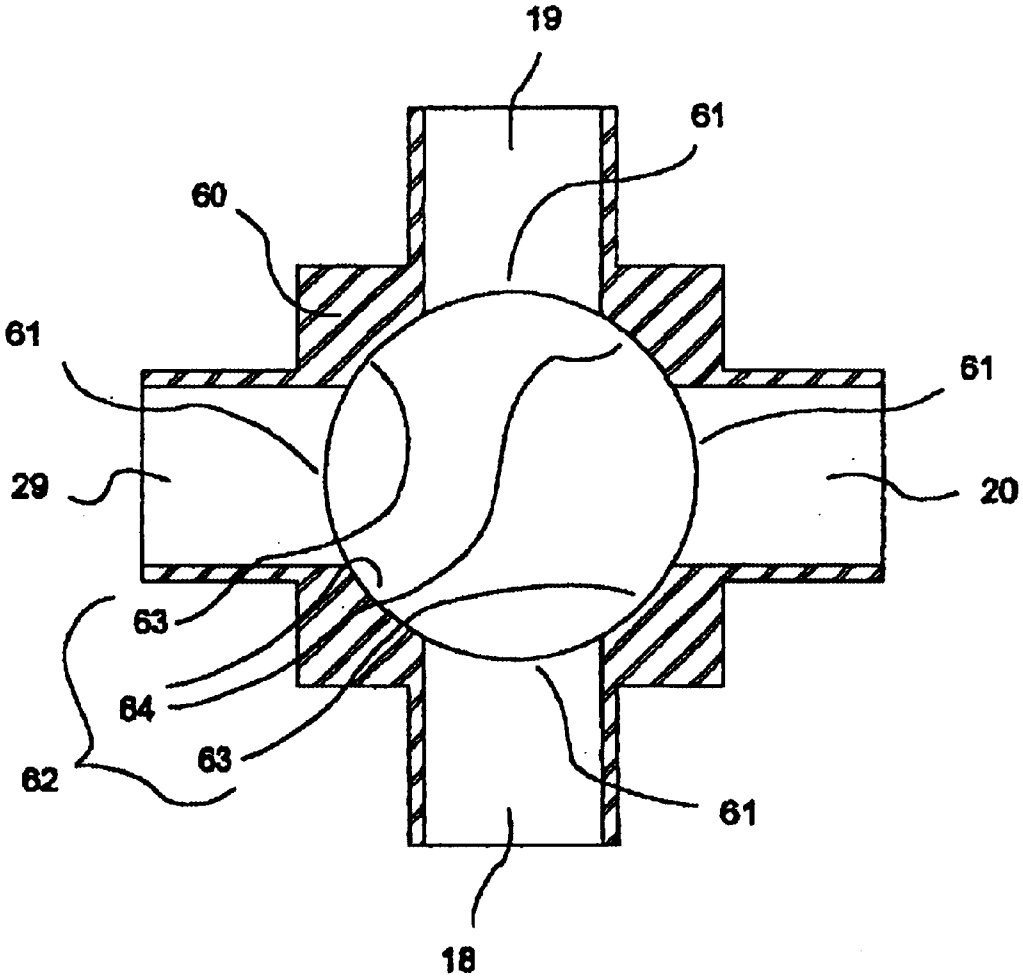
FIG. 12 is a sectional view of the 4-port tempering valve body of FIG. 11.

Referring now to FIG. 12, which illustrates another 4-port embodiment of tempering valve 11, a side cutaway view of the 4-port helix valve body 60, note the perpendicular spacing of the port apertures 61, and also the location of the valve seats 62 between the port apertures 61. In the "cold position" the helix blade 59 (shown in FIG. 11) comes in close proximity to the two cold seats 63 thus creating fluid communication between the engine port 29 and the by-pass port 18, and also creating fluid communication between the radiator hot port 19 and the radiator cold port 18. Then in the "hot position" the position of the helix diverter 56 (shown in FIG. 11) has been advanced by the thermostatic actuators 39 and now the helix blade 59 comes in close proximity to the hot valve seats 64 creating fluid communication between the engine port 29 and the radiator hot port 19, and also creating fluid communication between the radiator cold port 20 and the by-pass port 18.

In some instances it will be desirable to manually adjust the hydraulic resistance of the by-pass flow circuit 12 (FIG. 1) at the tempering valve 10 so that the system will be more adaptable to a wider variety of vehicles. Basically, a manual throttling mechanism that can be set to adjust the flow resistance to the by-pass port 18 of the valve 10 will allow the installer to approximately match the flow resistance of the by-pass circuit 12 to the flow resistance of the radiator 6. Such a mechanism (not shown) could be easily incorporated into the end plug 26. Such a mechanism would simply allow manual adjustment of the size of the by-pass apertures 28.

The present invention also has application with and can be readily adapted to any fluid circulation system, which incorporates a heat exchanger in the flow circuit, and in which a more uniform temperature within the heat exchanger is desirable. For example, but not as a limitation, referring to FIGS. 1–6, the engine 1 could represent or be replaced by any fluid circulation system and the radiator 6 could represent any heat exchanger. Installing either the 3-port tempering valve 10 as illustrated in FIGS. 1–3 or the 4-port tempering valve 11 as illustrated in FIGS. 4–6 would favorably result in more effective controlling of the temperature of the heat exchanger core 8 by sending less flow to the core when the fluid temperature is low and more flow to the core 8 when the fluid temperature is elevated. As described, the installation of the present invention into a the fluid flow circuit incorporating any fluid heat exchanger offers utility because controlling the temperature of the fluid within a heat exchanger allows operation of the heat exchanger at maximum or enhanced efficiency and also minimizes or eliminates the undesirable sooting of the heat exchanger fin tubes caused by natural gas or propane combustion exhaust gas.

What is claimed is:

1. A tempering valve for controlling a temperature of a fluid within a machine by dividing and proportioning flow of the fluid from the machine between a heat exchanger and a flow circuit that by-passes the heat exchanger, said tempering valve comprising:

a valve body with inlet port for connection to an effluent line of the machine to facilitate receiving the fluid from the machine, an outlet port for connection to an influent line for the heat exchanger to enable discharging the received fluid to the heat exchanger, and a by-pass port for connection to an influent line of the machine for discharging the received fluid from the machine;

a movable valve diverter positioned within said valve body, wherein the valve diverter is selectively positionable in at least three positions that create differing proportionate flow between the heat exchanger influent line and the by-pass port;

an actuator device positioned within the valve body in mechanical contact with the valve diverter, the actuator device being configured to sense temperature of the received fluid and to actuator in response to the sensed temperature to position said valve diverter in one of the valve diverter positions; and means for manually throttling hydraulic resistance to flow of the fluid to the by-pass port and the by-pas flow circuit, the throttling means being positioned within the valve body upstream of he by-pass and outlet ports.

2. The tempering valve of claim 1, wherein said valve body is cylindrical with an access port opposite the outlet port and said manual throttling means comprises a cylindrical end plug including the inlet port and being insertable in the access port so as to be manually rotated relative to the valve body, and further wherein the end plug includes a by-pass aperture on a side surface for discharging the received fluid radially, whereby positioning the end plug relative to the valve body effectively throttles flow by either aligning the by-pass aperture with the by-pass port to provides less resistance to flow or misaligning the by-pass aperture with the by-pass port to provide an increased resistance to flow.

* * * * *